US011834142B1

(12) United States Patent
Bushey

(10) Patent No.: US 11,834,142 B1
(45) Date of Patent: Dec. 5, 2023

(54) OARLOCK

(71) Applicant: Douglas P. Bushey, Wasilla, AK (US)

(72) Inventor: Douglas P. Bushey, Wasilla, AK (US)

( * ) Notice: Subject to any disclaimer, the term of this patent is extended or adjusted under 35 U.S.C. 154(b) by 154 days.

(21) Appl. No.: 17/690,478

(22) Filed: Mar. 9, 2022

(51) Int. Cl.
*B63H 16/06* (2006.01)
*B63H 16/067* (2006.01)
*B63H 16/04* (2006.01)

(52) U.S. Cl.
CPC ..... *B63H 16/067* (2013.01); *B63H 16/04* (2013.01); *B63H 16/06* (2013.01); *B63H 2016/043* (2013.01)

(58) Field of Classification Search
CPC ..... B63H 16/06; B63H 2016/063; B63H 16/067; B63H 2016/043; B63H 16/073; B63H 16/04
See application file for complete search history.

(56) References Cited

U.S. PATENT DOCUMENTS 551,265 A 12/1895 De Riar
2,550,625 A 4/1951 Vick
2,559,929 A * 7/1951 Bjork ..... B63H 16/06 403/57
2,657,401 A * 11/1953 Goserud ..... B63H 16/06 440/107
2,676,342 A * 4/1954 Tontrup ..... B63H 16/06 440/107
4,941,855 A 7/1990 Agner
5,213,529 A * 5/1993 Thomas ..... B63H 16/06 440/106
5,827,097 A 10/1998 Ando
9,376,190 B1 * 6/2016 Horan ..... B63H 16/06
D786,169 S 5/2017 Dingel
2018/0346084 A1 * 12/2018 Mitchell ..... B63H 16/067

* cited by examiner

*Primary Examiner* — Andrew Polay
(74) *Attorney, Agent, or Firm* — Michael Tavella

(57) ABSTRACT

An oarlock that is designed to be used with an oar-right. It is an oarlock that has a pin for securing the oarlock in an oar holder or gunwale of a boat. A U-shaped bracket is attached to the pin. There is a formed piece that has a cylindrical upper portion and a lower squared portion that is secured to the U-shaped bracket. An oar fits into the cylindrical upper portion and the oar-right fits into the lower squared portion of the formed member. The U-shaped bracket can rotate on the pin, which means that the oarlock can rotate 360 degrees and the formed member is free to pivot between the arms of the U-shaped bracket. Because the formed piece is a closed member, the oar cannot come out of the oarlock no matter how much the oar maybe moved or jostled by rough water, nor can the oar rotate on its own axis.

12 Claims, 6 Drawing Sheets

OARLOCK

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to oarlocks and particularly to closed oarlocks.

2. Description of the Prior Art

Oars have been used for as long as boats have been around. To work efficiently, oars must be held in some type of oarlock. Over the years many oarlocks have been invented. One of the most common is the open oarlock. This has a stem for attachment to the boat and a "U"-shaped body with an open top. The oar is placed in the open "U"-shaped body and can be used by maneuvering the oars in the normal way. One of the problems that is inherent with open oarlocks is that the oar can easily come out of the oarlock. This can happen at any time, but in river rafting it can become a serious problem. A rower must maneuver the oars quickly and efficiently in rough water. Having an oar "pop out" of the lock in such circumstances can cause serious problems or can even cause the raft to capsize.

Over the years people have attempted to address this problem—not only for rafting, but for normal row boats of all types. One of the ways to solve this problem is to simply close the oarlock. Some examples of such designs are found in the following U. S. Patents. U.S. Pat. No. 551,265 to Riar teaches an oarlock that has a base pin for fitting into the gunwale of a boat and a clamp that is secured to an oar. The clamp is a split clamp that secures at the top with a screw. The oarlock is designed to pivot on the pin. U.S. Pat. No. 2,469,355 to Areaux teaches an oarlock that has conventional ears and is secured to the oar by a pin, which passes through the oar. The Areaux device is actually an extension that allows the height of the oar to be adjusted. U.S. Pat. No. 2,550,625 to Vick, is an oarlock for use with sculling oars. It has a round clamp that fits over the oar, which is secured in the clamp by a screw. U.S. Pat. No. 4,941,855 to Agner teaches an oarlock that is pivotably attached to a gunwale post. The oar is held by a clamp that has two sides which are held together by nuts and bolts at the top and bottom of the clamp. The clamp is then bolted to the top of the gunwale pin. U.S. Pat. No. 5,827,997 to Ando teaches an oarlock that has a gunwale pin and a pivot and a clamp that has two bolts on top and two bolts on the bottom of the clamp. The clamp has a rectangular base that is pinned to the pivot on the gunwale pin.

The next device is that uses an oar holder that is the subject of U.S. Pat. No. D786,169. This is an oar holder that has a formed body that attaches to a side rail of a raft or that can be attached to a gunwale. At the top of the formed body is a hole that receives the gunwale pin of the oarlock. The second is a device called an oar-right. The oar-right is an oar stabilizing device that keeps the blade of the oar in an upright position at all times. The oar-right is typically used with a sleeve. FIG. 1, as Prior Art, shows the details of the oar-right with an oar. There is a side rail 100 and the oar holder 101 that is the subject of the design patent mentioned above. The oar lock 102 is shown mounted in the oar holder with fasteners 103 on the bottom. The horns 104 of the oar lock 102 are shown around an oar sleeve 105 that is attached to an oar shaft 106. The oar-right 107 is shown attached to the oar shaft and positioned over the sleeve as shown. Note that the oar-right fits between the horns of the oarlock as shown. Note that the oar shaft now cannot be turned in the oarlock because of the abutment 108 of the oar-right, which is the purpose of the oar-right. Unfortunately, there is nothing to prevent the oar shaft from coming out of the oar lock when moving in a raft-especially in rough water.

BRIEF DESCRIPTION OF THE INVENTION

The instant invention overcomes the difficulties described above. It is an oarlock that is designed to be used with the oar-right. For Rafting, it can also be used with the oar holder that is the subject of the design patent above. It is an oarlock that has a pin for securing the oarlock in the oar holder, or gunwale of a boat. There is a U-shaped bracket that is attached to the pin. The two arms of the U-shaped bracket have holes to accept pivot pins. The oarlock has a formed piece that sits over an inverted oar-right. The formed piece has a cylindrical upper portion and a lower squared portion. An oar fits into the cylindrical upper portion and the oar right fits into the lower squared portion. The formed piece is attached to the arms of the U-shaped bracket using the pivot pins. In addition, the U-shaped bracket is rotatably attached to the pin. This means that the oarlock can rotate 360 degrees about the pin and is free to pivot between the arms of the U-shaped bracket. Because the formed piece is a closed member, the oar cannot come out of the oarlock no matter how much the oar may be moved or jostled by rough water.

DETAILED DESCRIPTION OF THE INVENTION

Figure 1:
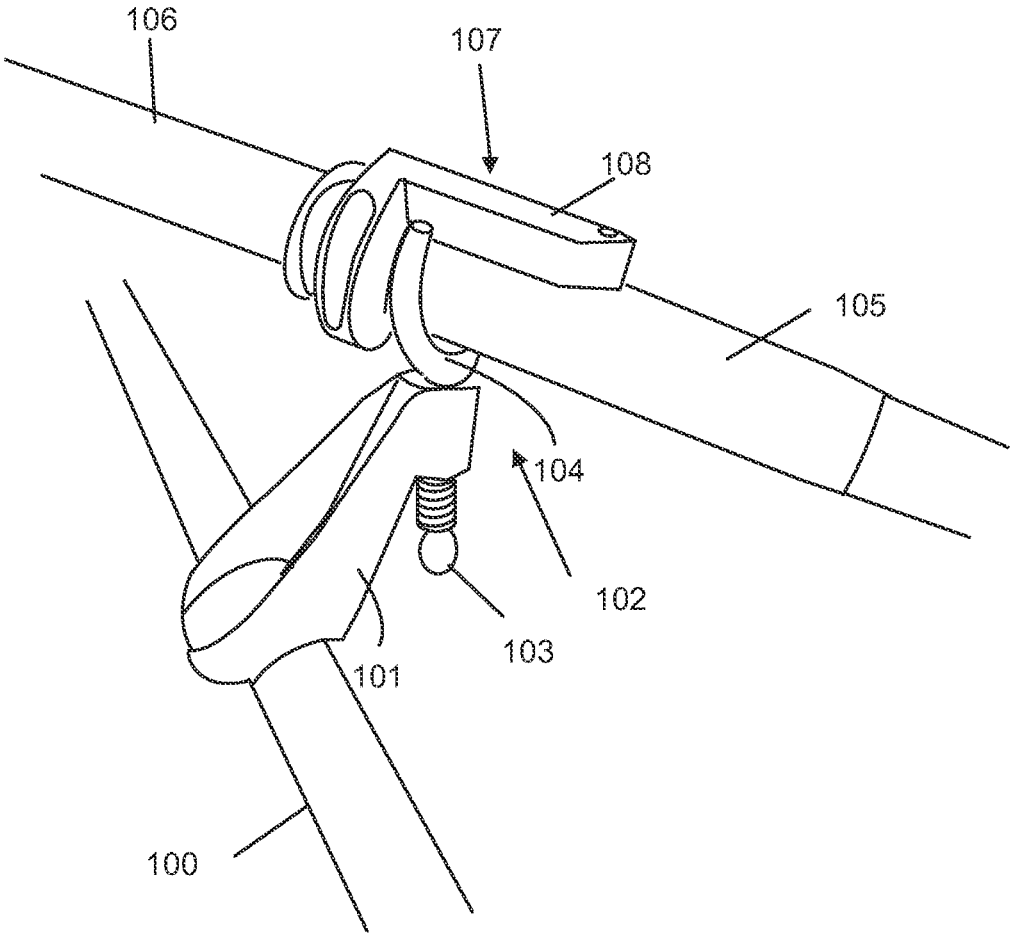
Figure 1 Prior Art
FIG. 1 is a detail view of an oar holder mounted to a rail, an oarlock, an oar-right, and an oar as prior art.
Figure 2:
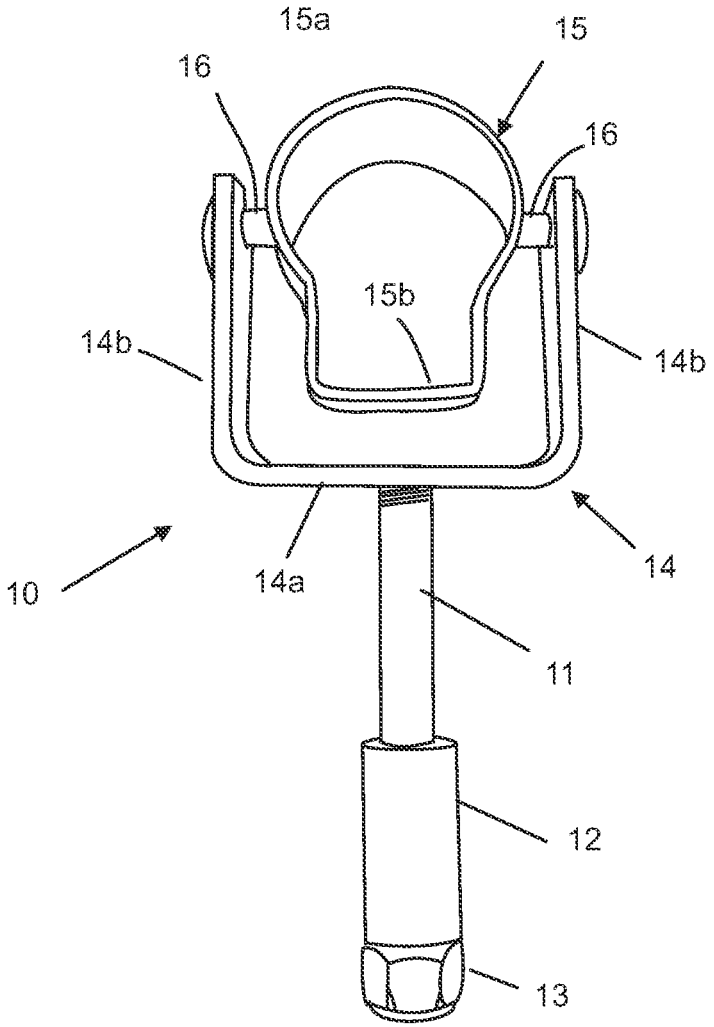
FIG. 2 is a front view of the oarlock of the instant invention.
Figure 3:
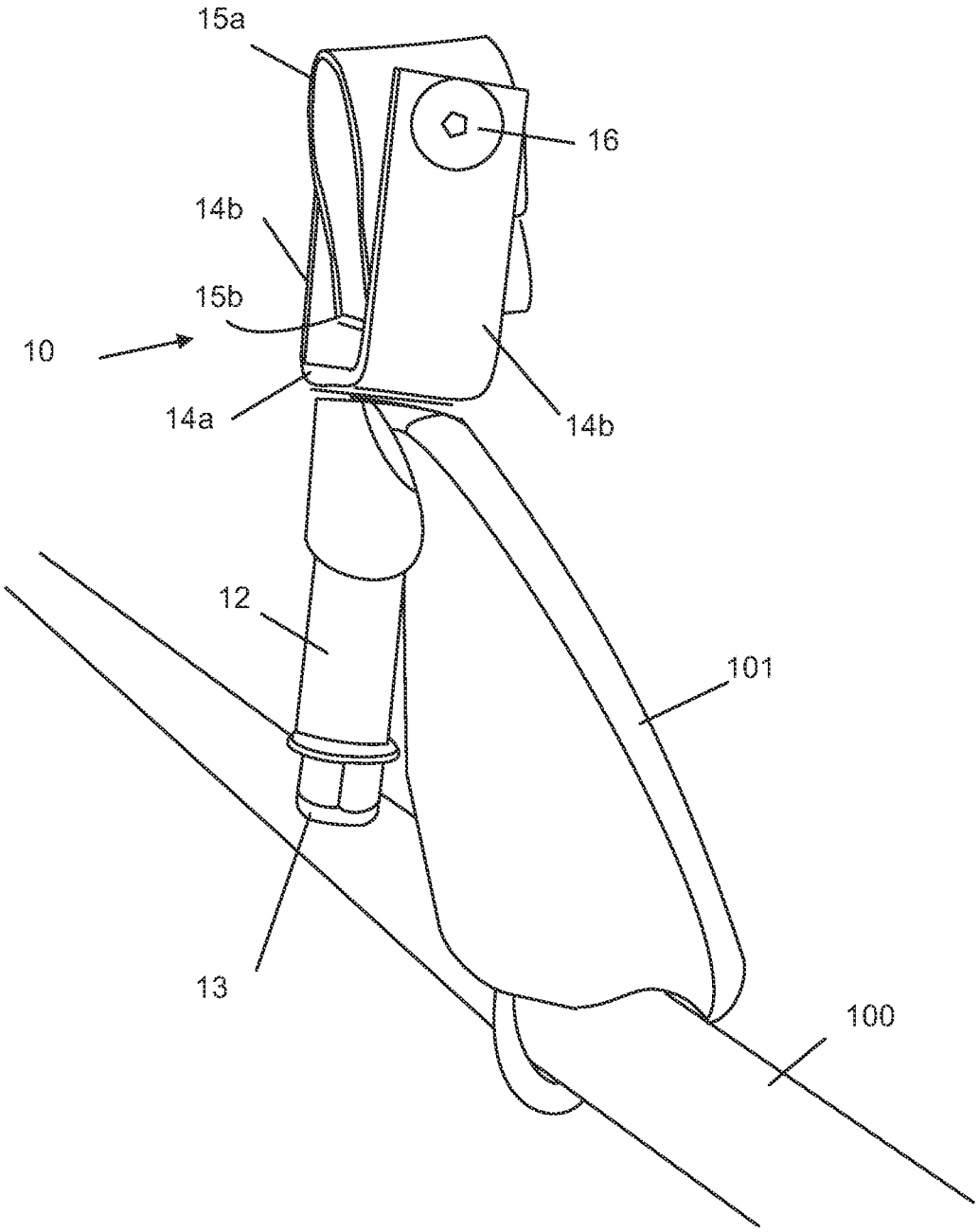
FIG. 3 is a side detail view of the oarlock mounted in an oar holder, which is attached to a rail.

Referring now to the drawing figures and especially, FIGS. 2, and 3, as shown in FIG. 2, the oarlock 10 of the instant invention comprises a pin 11 that has a lower threaded portion 12 and a nut 13 that is used to secure the pin to an oar holder or gunwale. At the top of the pin is a U-shaped bracket 14 that has a base 14*a* that is attached to the pin 11. Note that the base 14*a* is designed to be rotatably attached to the pin by suitable fastener means. The U-shaped bracket 14 also has two arms 14*b* that extend upwardly from the base 14*a*. A formed member is attached to the arms 14*a* of the U-shaped bracket by pivot pins 16. Note that the formed member 15 has a curved upper portion 15*a* and a squared lower portion 15*b*.

FIG. 3 is a side detail view of the oarlock 10 mounted in an oar holder 101, which is attached to a rail 100. Note that the oar holder 101 and the rail 100 are not part of the invention. The pin 11 of the oarlock 10 is shown in place within the oar holder 101. Note that the lower threaded portion 12 and a nut 13 are used to secure the pin to the oar holder, or gunwale. The rail is shown because it is used in river rafting boats of the type that run through white water. However, the device 10 can be used with any other oar mounting system.

The U-shaped bracket 14 that has a base 14*a* and two arms 14*b* that extend upwardly from the base 14*a* is shown sitting above the oar holder 101. In this way, the oar holder 101 holds the oarlock 10 without impeding the function of the oarlock 10. The formed member 15 is attached to the arms 14*a* of the U-shaped bracket by pivot pins 16. Note that the curved upper portion 15*a* of the formed member 15 in the figure is angled and can pivot freely in the U-shaped bracket.

Figure 4:
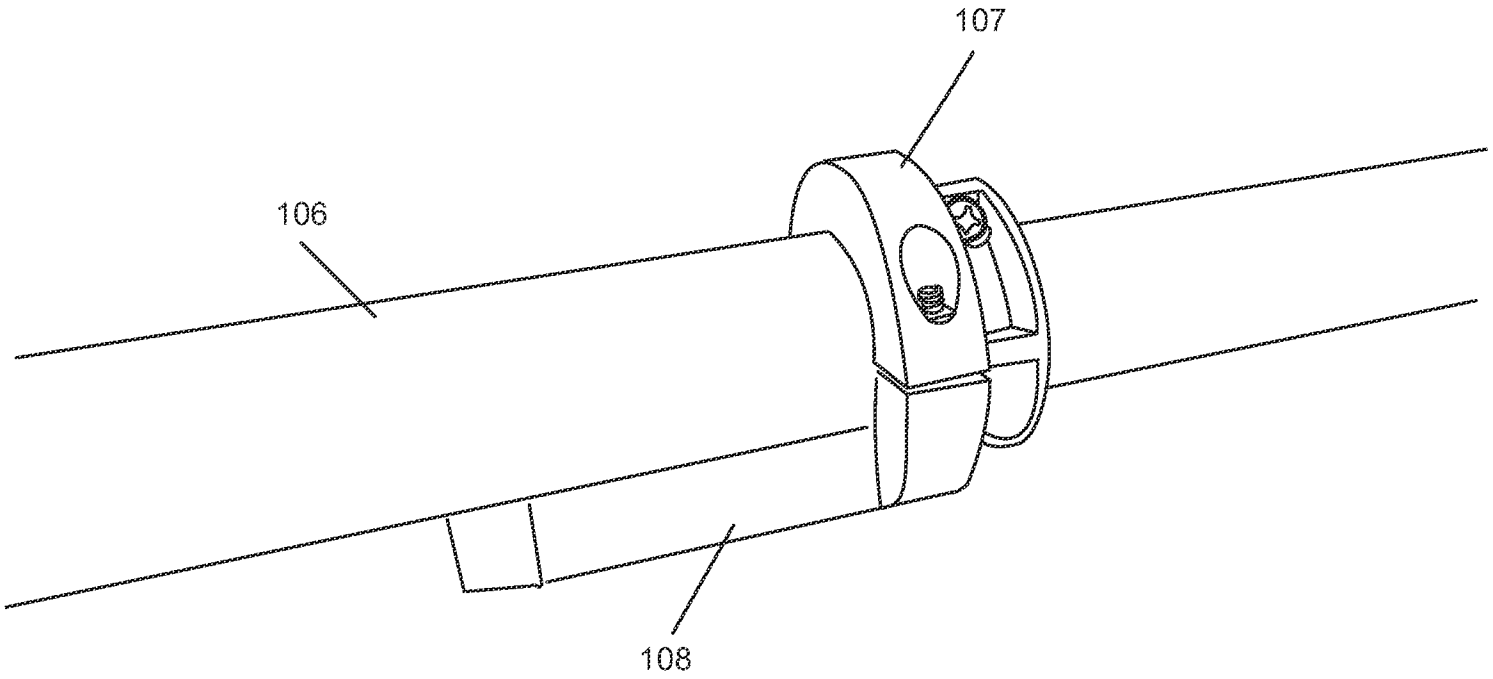
FIG. 4 is a detail view of an oar with an inverted oar-right attached.

FIG. 4 is a detail view of an oar 106 with an inverted oar-right 107 attached. This figure shows how the oar-right is positioned for use with the instant invention. Unlike the prior art use of the oar-right 107, which has the oar-right positioned atop the oar, here it is placed so that the rectangular shank or abutment 108 of the oar-right 107 is on the bottom of the oar 106. In this way, the squared lower portion 15*b* of the formed member 15 is aligned with the rectangular shank or abutment 108 of the oar-right 107.

Figure 5:
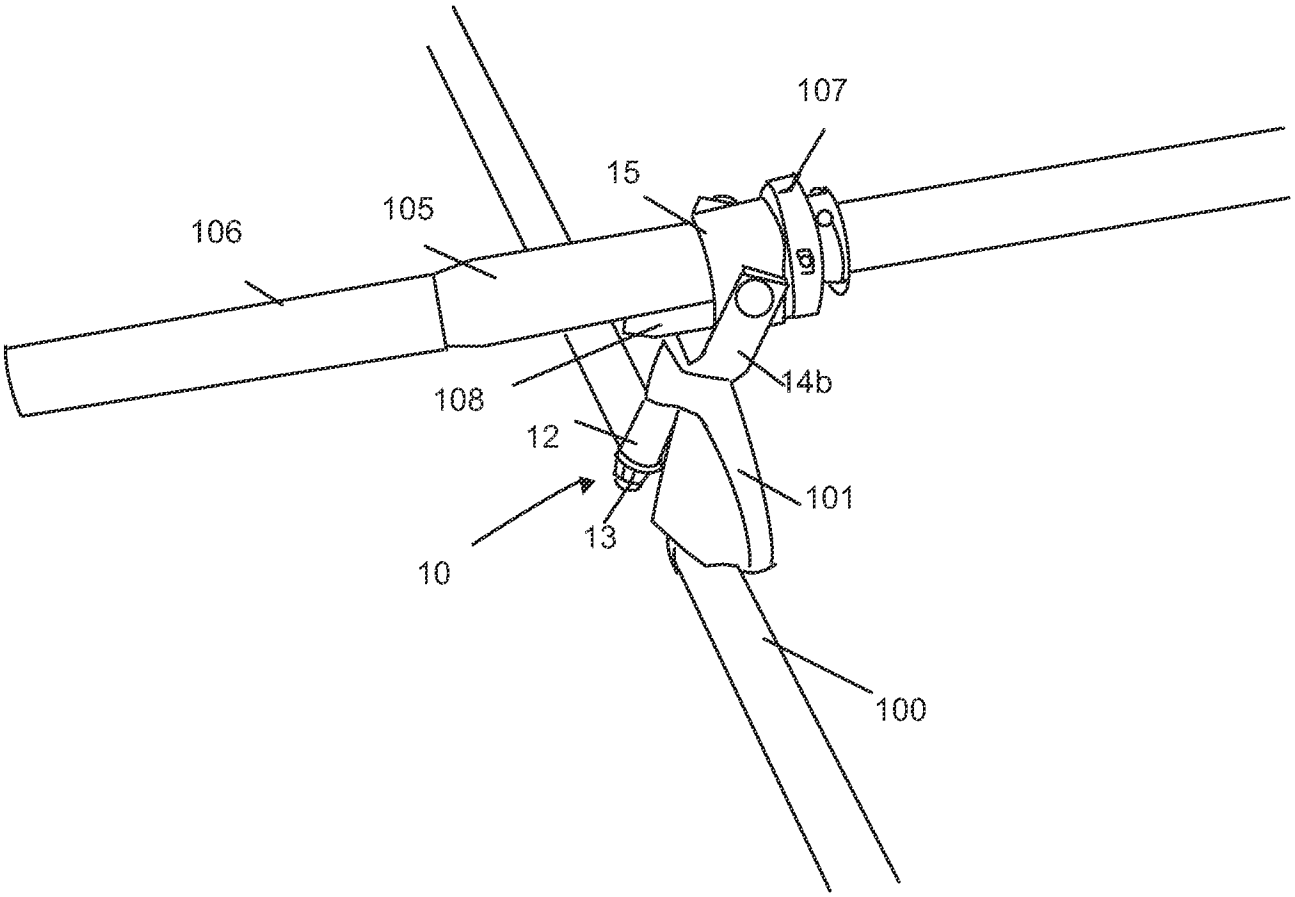
FIG. 5 is a detail view of an oar holder, which is attached to a rail, the instant invention, mounted in the oar holder, and an oar with an oar sleeve and the oar-right mounted in the oarlock.

FIG. 5 is a detail view of an oar holder 101, which is attached to a rail 100, the instant invention 10, mounted in the oar holder 101, and an oar 106 with an oar sleeve 105 and the oar-right 107 mounted in the oarlock 10. This figure shows the entire assembly. Note that the oar 106 passes through the curved upper portion 15*a* of the formed member 15 while the rectangular shank 108 of the oar-right 107 is in the squared lower portion 15*b* of the formed member 15 (see also FIG. 6). The oar 106, when held in this manner is free to move up and down and left and right, but cannot turn on its axis, as the oar-right prevents the oar from turning in the formed member, which is the purpose of this oarlock design.

Figure 6:
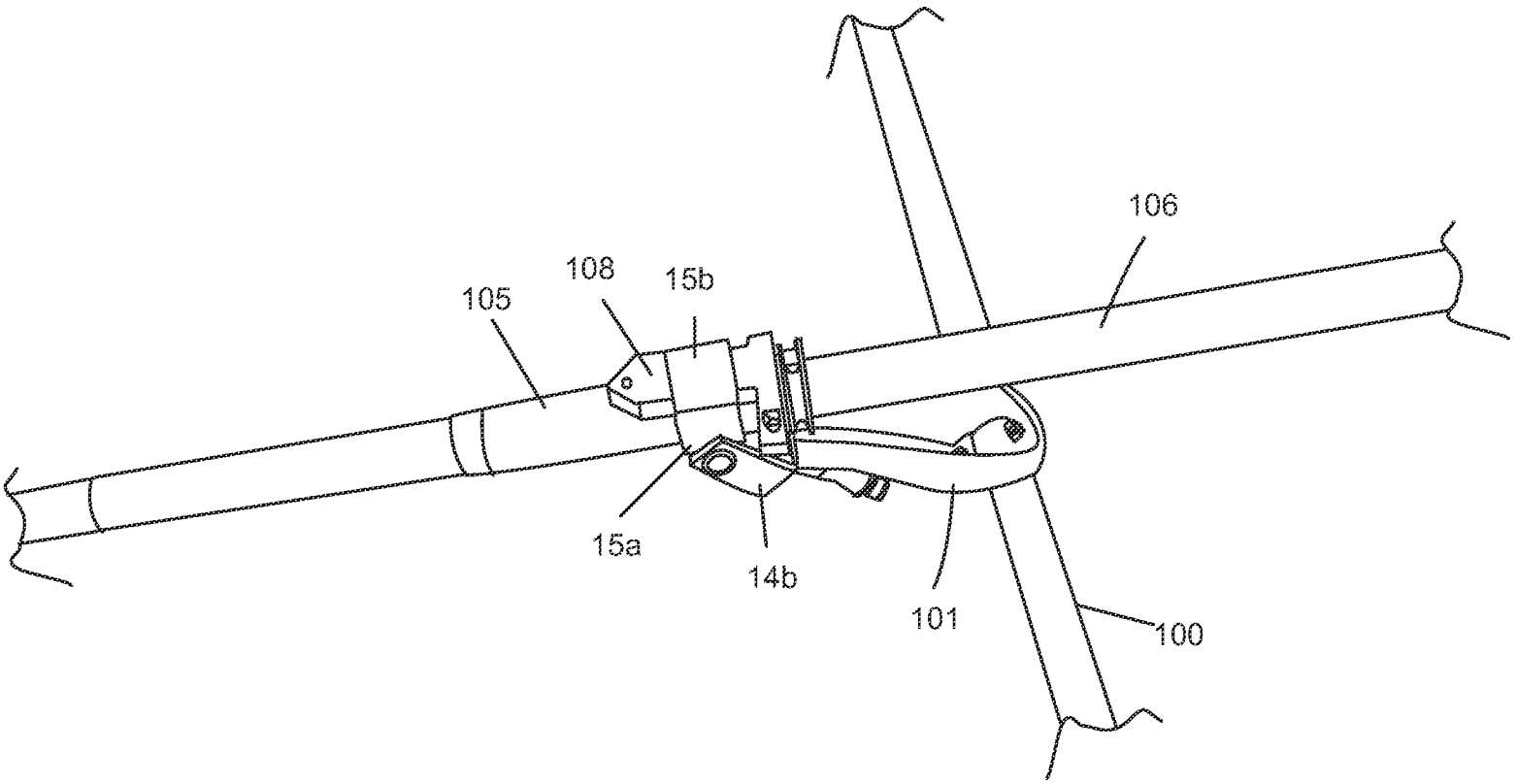
FIG. 6 is a is a detail view of an oar holder, which is attached to a rail, the instant invention, mounted in the oar holder, and an oar with an oar sleeve and the oar-right mounted in the oarlock, showing the formed member of the oarlock upside down.

FIG. 6 is a is a detail view of an oar holder 101, which is attached to a rail 100. The instant invention 10, is mounted in the oar holder 101, and an oar 106 with an oar sleeve 105 and the oar-right 107 is mounted in the oarlock. showing the formed member 15*b* of the oarlock upside down. In this view, the rectangular shank 108 of the oar-right 107 is clearly shown inside the squared lower portion 15*b* of the formed member 15, which, as noted above, prevents the rotation of the oar 106 on its axis.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. An oarlock comprising:

a) a pin that has a lower threaded portion;

b) a U-shaped bracket, that has a base and has two spaced-apart arms that extend upwardly from the base; and c) a formed member, said formed member being a one-piece member having a curved upper portion, and a squared lower portion, said formed member being pivotably attached to the two spaced-apart arms of the U-shaped bracket.

2. The oarlock of claim 1 further comprising: a nut, attached to said lower threaded portion of said pin.

3. The oarlock of claim 1 wherein the base is rotatably attached to said pin.

4. The oarlock of claim 1 wherein the base of said U-shaped bracket is generally rectangular, having a first end and a second end.

5. The oarlock of claim 4 wherein one of said two spaced apart-arms is attached to the first end of the base of the U-shaped bracket and the other of said two spaced-apart arms is attached to the second end of said base of the U-shaped bracket.

6. The oarlock of claim 1 wherein the formed member is attached to said U-shaped bracket by pivot pins.

7. An oarlock for an oar, having a member having rectangular shank attached to the bottom of the oar, comprising:

a) a pin that has a lower threaded portion;

b) a U-shaped bracket, that has a base and has two spaced-apart arms that extend upwardly from the base; and c) a formed member, said formed member being a one-piece member having a curved upper portion, and a squared lower portion, said formed member being pivotably attached to the two spaced-apart arms of the U-shaped bracket, whereby said oar is positioned in said curved upper portion and said rectangular shank is positioned in said squared lower portion.

8. The oarlock of claim 7 further comprising: a nut, attached to said lower threaded portion of said pin.

9. The oarlock of claim 7 wherein the base is rotatably attached to said pin.

10. The oarlock of claim 7 wherein the base of said U-shaped bracket is generally rectangular, having a first end and a second end.

11. The oarlock of claim 10 wherein one of said two spaced apart-arms is attached to the first end of the base of the U-shaped bracket and the other of said two spaced-apart arms is attached to the second end of said base of the U-shaped bracket.

12. The oarlock of claim 7 wherein the formed member is attached to said U-shaped bracket by pivot pins.

* * * * *